US007261433B2

(12) United States Patent
Parsons et al.

(10) Patent No.: US 7,261,433 B2
(45) Date of Patent: Aug. 28, 2007

(54) MINIATURE FLASHLIGHT HAVING REPLACEABLE BATTERY PACK AND MULTIPLE OPERATING MODES

(75) Inventors: Kevin L. Parsons, Appleton, WI (US); W. Clay Reeves, Carrollton, TX (US)

(73) Assignee: Armament Systems and Procedures, Appleton, WI (US)

( * ) Notice: Subject to any disclaimer, the term of this patent is extended or adjusted under 35 U.S.C. 154(b) by 252 days.

(21) Appl. No.: 10/627,435

(22) Filed: Jul. 25, 2003

(65) Prior Publication Data

US 2004/0114359 A1 Jun. 17, 2004

Related U.S. Application Data

(63) Continuation-in-part of application No. 10/140,275, filed on May 6, 2002.

(51) Int. Cl.
*F21L 4/04* (2006.01)

(52) U.S. Cl. ..... 362/205; 315/200 A; 315/362

(58) Field of Classification Search ..... 362/205, 362/251, 276, 212, 200, 802, 204; 315/362, 315/209 R, 200 A; 307/139; 200/60
See application file for complete search history.

(56) References Cited

U.S. PATENT DOCUMENTS

| | | | | |
|---|---|---|---|---|
| 6,190,018 | B1 * | 2/2001 | Parsons et al. | 362/116 |
| 6,249,089 | B1 | 6/2001 | Bruwer | |
| 6,621,225 | B2 * | 9/2003 | Bruwer | 315/86 |
| 2003/0137834 | A1 * | 7/2003 | Jigamian et al. | 362/205 |
| 2003/0147239 | A1 * | 8/2003 | Galli | 362/205 |

* cited by examiner

*Primary Examiner*—Renee Luebke
*Assistant Examiner*—Evan Dzierzynski
(74) *Attorney, Agent, or Firm*—Welsh & Katz Ltd.

(57) ABSTRACT

A method and apparatus are provided for operating a flashlight using a light emitting diode as a primary light source. The method includes the steps of activating the light emitting diode as the primary light source of the flashlight under one of a plurality of different operating modes and selecting the operating mode using a momentary contact disposed on an outer surface of the flashlight. In the disclosed embodiments, the flashlight takes the form of a relatively small size, generally flat housing having metallic side panels that may be of various colors and have indicia printed on them. The housing has an integral keyring extension enabling an article to be attached to the flashlight or for the flashlight to be attached to other articles, such as the clothing of a user.

58 Claims, 13 Drawing Sheets

MINIATURE FLASHLIGHT HAVING REPLACEABLE BATTERY PACK AND MULTIPLE OPERATING MODES

This application is a continuation-in-part of U.S. application Ser. No. 10/140,275 filed on May 6, 2002, entitled Miniature Flashlight Having Replaceable Battery Pack And Multiple Operating Modes, and currently pending.

FIELD OF INVENTION

The present invention relates generally to flashlights, and more particularly to a miniature flashlight utilizing a light emitting diode ("LED") light source and a replaceable modular battery pack operative in response to predetermined switch actuation to effect momentary, selective signaling or continuous energizing of the LED.

BACKGROUND OF THE INVENTION

Conventional general-purpose flashlights are well known and find wide application by both law enforcement personnel and civilians. For example, flashlights are often used by law enforcement personnel during traffic stops to illuminate the interior of a stopped vehicle or to complete a police report in the dark. They are also used to facilitate searches of poorly lit areas and may be used to illuminate dark alleys or stairwells. Law enforcement personnel also use flashlights to check or adjust their equipment when positioned in a darkened area or at nighttime. Flashlights may also be used to send coded signals to one another. Thus, it is essential that law enforcement personnel carry a flashlight along with other law enforcement equipment such as, a sidearm, handcuffs, and an expandable baton. With such a large number of items, it is often difficult and cumbersome for law enforcement personnel to carry all of the items on their person.

Conventional flashlights generally include an incandescent lightbulb and drycell batteries enclosed in an elongated tubular casing typically consisting of a body section and a head section. Flashlights of this type are often bulky and cumbersome. Law enforcement personnel frequently use a holster to carry a flashlight on their person. The size and weight of conventional flashlights can inhibit the mobility of law enforcement personnel when carried along with the other law enforcement equipment, and sometimes leads to the flashlight being purposely or inadvertently left behind. This presents a problem when the need for a flashlight arises and one is not readily accessible.

In addition to the use of flashlights by law enforcement personnel, civilians also use flashlights for a number of reasons. Besides the traditional home uses of flashlights, smaller flashlights are used for various security purposes. For example, when going to one's car late in the evening, it is not uncommon for an individual, especially a female, to carry a small flashlight with her. She can use the flashlight to assist in locating the keyhole in the dark. Additionally, she can use the flashlight to check whether someone is hiding in the back seat before getting into the car. Even small conventional flashlights, however, are cumbersome and inconvenient to carry for this purpose.

DESCRIPTION OF THE PRIOR ART

Although not proven particularly useful to law enforcement personnel, there exists in the prior art a small flashlight known as the Photon Micro Light The Photon Micro Light consists of two flat, circular 3-volt batteries, a light emitting diode ("LED") and an outer shell that encloses the batteries and leads of the LED. The Micro Light uses a slide switch or pressure switch that activates the light by moving the leads of the LED into direct engagement with the batteries. The outer shell consists of two hard plastic shell halves disposed on opposite sides of the batteries and held together with threaded screws. The Micro Light has a number of disadvantages in that it lacks the durability required for a miniature flashlight, and also lacks an internal structure for protecting and securing the batteries and LED, having only the hard plastic outer shell to protect the internal components. The Micro Light may therefore be adversely affected when subjected to shock. Further, the use of screws to assemble the outer shell halves together increases the time and cost of assembly. In addition, the Micro Light has a very small keyring hole that is not well adapted for securing the flashlight to a keychain, or to otherwise readily attach and release the flashlight from one's clothing.

Another major drawback with the Micro Light is that it uses either a slide switch or pressure switch which upon activation brings both leads of the LED into direct engagement with the batteries. This results in increased fatigue on the leads of the LED and ultimately results in failure. Moreover, because of its external shape and hard plastic outer shell construction, the Micro Light is not suitable for receiving markings or engravings on the outside surfaces thereof In many instances it is desirable to color code the exterior of the flashlight, or to provide engravings, markings, or other indicia on the exterior surface. The Micro Light is not well suited for any such color coding or desired markings or engravings.

The aforedescribed drawbacks experienced with prior conventional flashlights and the reduced size Photo Micron Light created a need for a compact, reliable and lightweight flashlight that assures long life and can be readily carried on the person of a law enforcement officer or civilian, such as being easily releasably attachable to one's clothing or a keychain to insure that the flashlight remains in possession of the user and can be quickly accessed when needed. This need has been met in large part by the miniature LED flashlight disclosed in U.S. Pat. No. 6,190,018 that is assigned to the assignee of the present invention and is incorporated herein by reference.

SUMMARY OF THE INVENTION

The subject invention is directed to a small, compact flashlight useful to both law enforcement personnel and civilians. The flashlight includes a light source, which is preferably a high intensity LED having a pair of leads extending therefrom, and a non-conductive power source frame, also termed a battery frame, having a cavity or recess opening outwardly of the battery frame and adapted to releasably receive a modular self-contained power source, such as a modular battery pack. The battery frame also has a recess for receiving and at least partially enclosing the LED such that the LED leads extend into the battery frame.

The battery frame includes a printed circuit board plate and attached printed circuit board that together defines a side boundary of the recess that receives the modular battery pack. The battery frame also has a momentary contact pushbutton. A processor on the printed circuit board activates the LED under one of a number of different operating modes. The pushbutton may be used to select and control an operating mode of the LED.

A pair of side covers are retained on opposite sides of the battery frame by side shell members so that outer surfaces of the side covers are exposed for receiving indicia thereon. The switch push button is received through a suitable opening in the side cover adjacent the printed circuit board so as to enable an operator to actuate the push button to effect momentary or continuous interconnection of the LED to the battery pack without either lead of the LED physically contacting the battery pack. The battery frame protects the modular battery pack and positions it in precise relation to the light source and the switch slide plate. The battery frame also cushions the internal elements from the adverse affects of any shock the flashlight might be subjected to.

The battery pack power source has sufficient power to energize the LED and preferably includes a pair of circular batteries having generally flat sides, frequently referred to as coin cells. A pair of stacked long-life 3-volt batteries of the coin cell type are enclosed within a non-conductive battery holder sized to be slidingly inserted within the similar size recess in the battery frame. The battery holder and battery frame are mutually cooperable to prevent full insertion of the battery pack into the recess unless the battery holder is disposed in a predetermined orientation, thus assuring proper positioning of the positive and negative terminals of the batteries relative to the LED leads. The battery holder has a boss or pusher member thereon that extends into an opening in the battery frame so that a pusher member on a similar battery pack can be inserted into the opening from externally of the flashlight to initiate removal of a battery pack disposed within the recess.

As noted, the light source is preferably an LED that has a high luminous intensity. Manufacturers of LEDs grade the LED according to its quality. The highest quality LEDs are given an "E" grade. The next highest quality is a "D" grade. LEDs with a "D" grade can be equipped with a lens to approximate the quality of an "E" grade LED. Although the flashlight of the present invention can be used with any conventional LED, an "E" grade LED or lensed "D" grade LED is preferred. Such a high intensity LED may be obtained from Nichia Corporation Tokushima, Japan, and has from three to five times the luminous intensity of a conventional LED. The LED preferably emits blue light, although the present invention may be used with any color LED. Blue light helps to preserve a user's night vision compared with conventional flashlights emitting white light. The use of a high intensity LED as the light source provides significant advantages over conventional filament type flashlight bulbs. A LED light provides a soft general illumination as compared to the bright glare or "white out" experienced with traditional filament lamps. This is particularly important in police and security work where a police officer requires lighting, such as in a vehicle, but for security reasons does not want to use a bright light that lights up the inside of the vehicle and makes the officer a "target" as experienced with traditional flashlights. Moreover, the bright light of traditional filament type flashlight makes it hard to write a report due to glare and grossly inhibits the officer's night vision. For other applications blue-green LEDs can be used, for example, in situations where compatibility with night vision equipment is desired. Other LED colors can also be used. Red LEDs can be used in applications where the preservation of night vision is desired or for use by pilots and photographers. Infrared LEDs can be used where special signaling capabilities are required or for use with equipment that senses infrared light.

One lead of the LED engages a first electrical conductor contact that is supported by the printed circuit board and coupled to a switch terminal of the printed circuit board. The other LED lead is similarly adapted to be contacted by a second electrical conductor contact supported by the printed circuit board. The second conductor contact contacts the positive terminal of the battery pack through an opening in the battery holder. A third electrical conductor contact is supported by the printed circuit board so as to contact a negative terminal of the battery pack in the battery frame recess through an opening in the battery holder. A switching arrangement within the printed circuit board functions to activate the LED by internally electrically connecting the first electrical conductor to the third electrical conductor.

In this manner, the LED leads are never flexed to make direct contact with the batteries in the battery pack. The switch arrangement thus reduces wear and possible fatigue failure of the leads of the LED, thereby increasing the life and overall reliability of the flashlight.

The battery frame may have a plurality of pegholes located about the periphery of each side to receive correspondingly positioned pegs or pins formed on the inner periphery of the side shells to facilitate attachment. The mating pegs and pegholes facilitate assembly of the flashlight by allowing the parts to be precisely aligned during assembly. It has been found that gluing the side shells to the battery frame to secure the side covers against the opposite sides of the battery frame may also provide a suitable assembly technique. Alternately, ultrasonic welding can be used to attach the non-metallic parts. Unlike the prior art, separate screws are not needed to secure the parts in assembled relation.

The side covers are fixed against opposite sides of the battery frame by the outer open side shells or frames so as to lie in substantially parallel planes and preferably have generally flat outer surfaces that are capable of receiving engravings or markings. For example, a company or individual may wish to engrave or imprint the side covers with surface indicia such as a company logo, name of a product or other promotional or advertising indicia on either or both of the side covers. A die struck medallion could also be affixed to one or both side covers. The side covers can be made of a variety of materials, such as metal, plastic, or other protective materials, but are preferably made of a suitable strength aluminum. Aluminum side panels provide additional protection to the internal components of the flashlight, can be of different contrasting colors as between themselves and between themselves and the outer periphery of the battery frame and/or open side shells, and can be easily engraved or imprinted as by laser engraving, silk screening, inking, pad printing, or other known printing or marking techniques.

The battery frame is provided with a keyring extension that is preferably formed integral with the battery frame. The keyring extension extends outwardly from an end of the battery frame opposite the LED and includes a keyring lock such that when a force is exerted against the keyring lock, the keyring extension is opened to permit keys or a keyring to be attached to the keyring extension. The keyring lock is preferably spring-biased and may be pivotally mounted on the battery frame. The keyring extension also facilitates attachment and detachment of the flashlight from any number of items, such as the zipper actuator of a coat or backpack, the handle of a purse or briefcase, a beltloop, or any other handle or case.

The flashlight of the present invention is preferably made sufficiently small, flat and compact to be readily carried in the palm of one's hand or in a pocket or purse, on the clothing, or on the keychain of law enforcement personnel or civilians. In this manner, the flashlight may be quickly and readily retrieved and operated.

One of the primary objects of the present invention to provide a flashlight that is of a small, relatively flat and compact size, is exceptionally durable and reliable, and utilizes a battery frame to support and protect a light source, preferably a high-intensity LED, a power source in the form of a replaceable modular battery pack, and a switch mechanism that is operative to close a circuit including the battery pack and LED to enable momentary or continuous energizing of the LED in a number of operating modes without the LED leads physically contacting batteries of the battery pack.

Further objects, advantages and features of the present invention will become apparent to those skilled in the art from the following detailed description of preferred embodiments when taken in conjunction with the accompanying drawings in which like reference numerals designate like elements throughout the several views.

Figure 1:
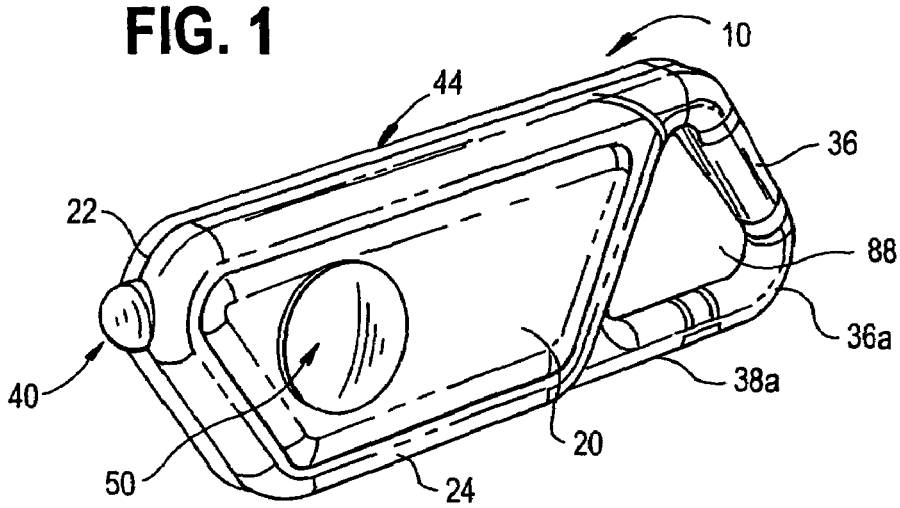
FIG. 1 is a perspective view of a flashlight constructed in accordance with the present invention.

While the present invention is susceptible of various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the invention is intended to cover all modifications, equivalents and alternatives falling within the spirit and scope of the invention.

DETAILED DESCRIPTION

Figure 2:
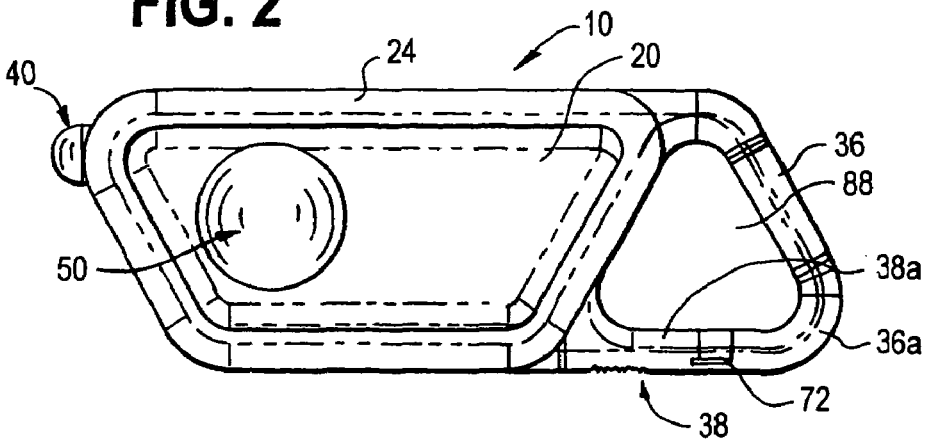
FIG. 2 is a side elevational view of the flashlight depicted in FIG. 1.
Figure 3:
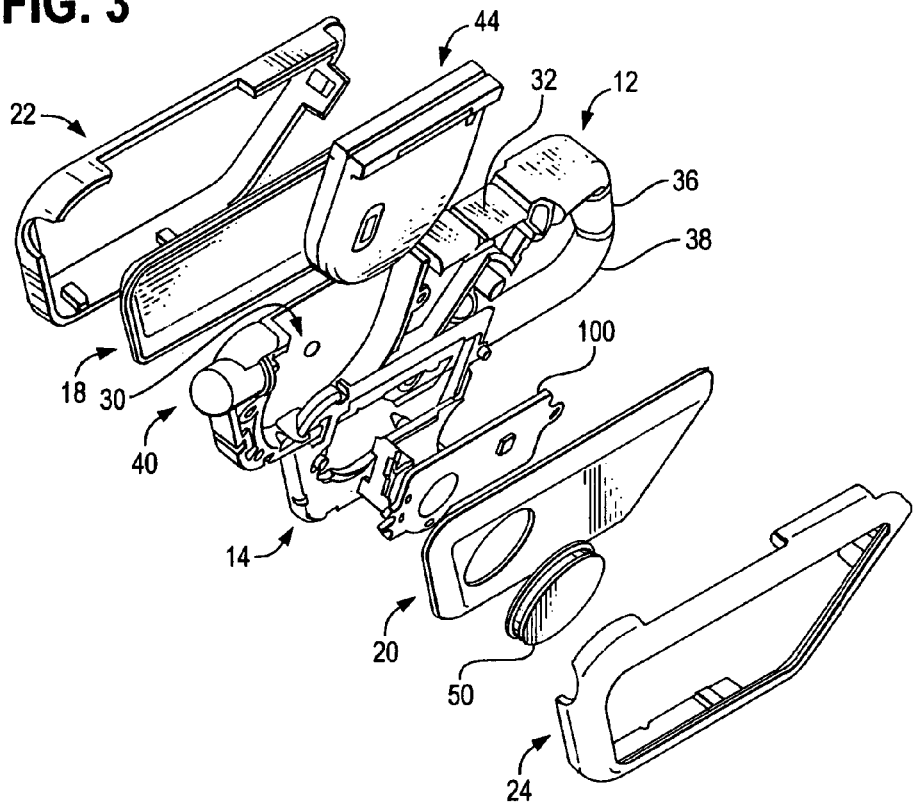
FIG. 3 is an exploded perspective view of the flashlight of FIGS. 1 & 2.

Referring now to the drawings, and in particular to FIGS. 1-3, a miniature handheld flashlight made in accordance with the present invention is indicated generally at 10. Very generally, and as illustrated in the exploded view of FIG. 3, the flashlight 10 has a housing which, in the preferred embodiment, includes a battery frame 12 that supports a high intensity light source 40 at a front end of the battery frame and to which is attached a printed circuit board (PCB) plate 14 and attached PCB 100, side covers 18 and 20, and open centered side shells or frames 22 and 24 that retain the side covers against opposite side of the battery frame. The battery frame 12, PCB plate 14 and PCB 100 cooperate to define a recess or chamber 30 that extends into the battery frame and opens outwardly of an edge surface 32 of the battery frame to facilitate sliding insertion of a replaceable battery pack as indicated at 44.

A keyring extension 36 is formed on an end of the battery frame 12 opposite the light source 40 and includes a keyring lock 38 that enables attachment of keys or a keychain to the keyring extension, or attachment of the flashlight to one's clothing or other item. As shown, the battery frame 12, side covers 18, 20, side shells 22, 24 and keyring extension define a housing that is relatively thin or flat in edge profile and has substantially greater longitudinal length than height, as considered in FIG. 2.

Figure 4:
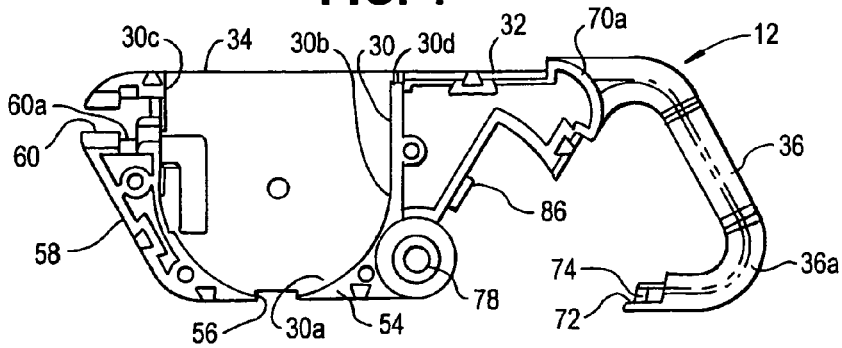
FIG. 4 is a side elevational view of one side of the power source battery frame employed in flashlight of FIG. 1.
Figure 5:
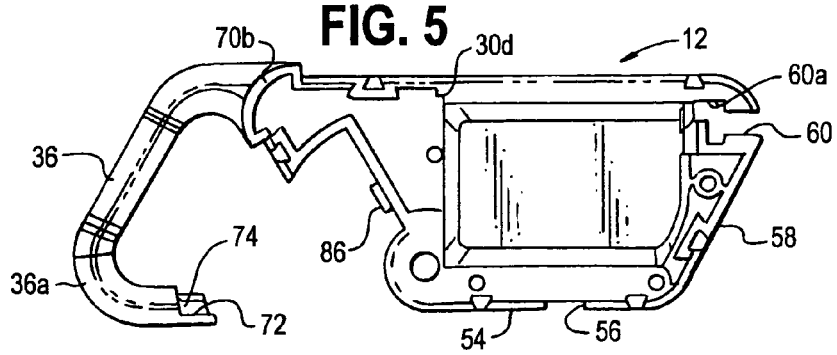
FIG. 5 is an elevational view of the opposite side of the battery frame of FIG. 4.

Turning now to a more detailed description of the various components of the flashlight 10, and referring particularly to FIGS. 4 and 5, the battery frame 12 is preferably made of a non-conductive material, such as polycarbonate, which provides exceptional durability and toughness. The battery frame 12 may also be made of other non-conductive materials having suitable strength and durability characteristics. As illustrated in FIG. 4, the battery frame 12 has a first side defining a portion of the recess 30. In the illustrated embodiment, the recess 30 has a semi-circular bottom surface portion 30*a* which terminates at its upper ends in parallel rectilinear walls surfaces 30*b* and 30*c*. The lower curved wall surface 30*a* intersects a bottom or lower edge surface 54 of the battery frame to form a generally rectangular opening 56 that provides access to the recess 30. The battery frame has a front end wall surface 58 that lies in a plane inclined to the upper and lower edge surfaces 32 and 54, respectively, of the battery frame and terminates at its upper end in a recess or chamber 60 configured to receive the light source 40.

Figure 21:
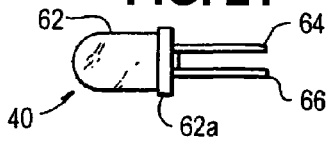
FIG. 21 illustrates an LED light source having leads extending therefrom as employed in the flashlight of FIG. 1.

As illustrated in FIG. 21, the light source 40 preferably comprises a high intensity light emitting diode ("LED") 62 having first and second leads 64 and 66. The LED 62 has an annular ring 62*a* thereon which couples with a semi-annular grove 60*a* formed in the recess 60 so as to maintain the LED in substantially fixed relation to the battery frame 12 when inserted into the recess 60. The LED light source provides significant advantages over conventional neon or incandescent filament light sources since it requires much less energy, is smaller in size, more resistant to shock, and provides a soft general illumination without "white out" or glare as experienced with traditional filament type light sources. The LED also generates significantly less heat and is more durable than a conventional light source. LED's are widely available, inexpensive, and can be readily replaced. In a preferred embodiment, the LED is a high intensity LED having a light luminous intensity emitting blue light, preferably a LED "E" grade or a lensed "D" grade.

Figure 28:
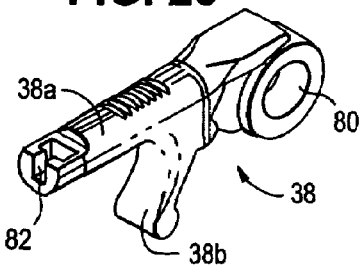
FIG. 28 is a perspective view, on an enlarged scale, of the keylock shown in FIG. 3.

Referring to FIGS. 4 and 5, taken in conjunction with FIGS. 2 and 28, the keyring extension 36 is preferably made of the same polycarbonate material as the remainder of the battery frame 12 and is formed integral with the remainder portion. The keyring extension 36 preferably blends into the upper edge surface 32 of the battery frame and is of greater transverse width at that point so as to define arcuate edge surfaces 70*a* and 70*b* that will eventually mate with correspondingly curved surfaces on the open center side shells or frames 22 and 24 so as to form a smooth and aesthetically pleasing exterior surface of the flashlight 10. The keyring extension 36 extends from its upper end in an inclined direction generally parallel to the front end surface 58 of the battery frame. This portion of the keyring is of generally cylindrical configuration and formed with a rounded lower corner 36*a* so as to terminate in a notched end 72 having an upstanding short wall 74 of less width than the diameter of the end 36*a* of the keyring extension.

The battery frame 12 has a cylindrical boss or hub 78 formed integral thereon so as to extend transversely of the longitudal axis of the battery frame. The boss 78 pivotally supports the keyring lock 38 through a cylindrical bore 80 (FIG. 28) in the keyring lock. As illustrated in FIG. 28, the keyring lock 38 has an arm 38*a* that lies in a plane disposed generally transverse to the axial center of the bore 80 and has a length sufficient to cause a notched end 82 of the arm 38*a* to releasably couple with the upstanding wall 74 on the notched end 72 of the keyring extension 36*a* when the keyring lock is in a closed position as shown in FIG. 2. As shown in FIG. 3, a coil compression spring is interposed between a boss 86 formed on the battery frame 12 and a boss (not shown) on an arm 38*b* of the keyring lock 38 so as to bias the keyring lock into a releasable locking or engaging position with the end 72 of the keyring extension 36*a*. The keyring extension 36 and keyring lock 38 cooperate to define a generally rectangular opening 88 that readily enables keys or a keychain to be inserted into the opening 88 for connection to the keyring extension by depressing the keyring lock against the compression spring. The opening 88 is also sufficiently sized to enable the flashlight to be connected to one's clothing, such as over a pocket edge, through a belt loop, or through a buttonhole.

Figure 12:
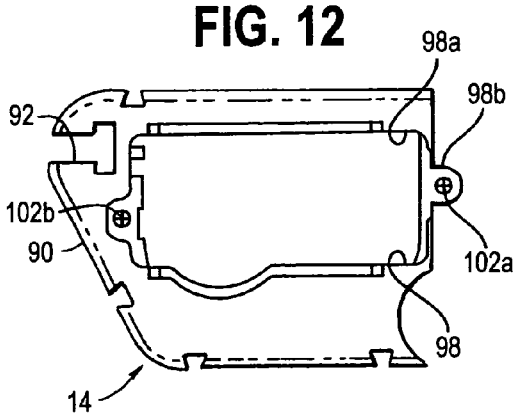
FIG. 12 is a side elevational view of the PCB plate that cooperates with the battery frame to establish the modular battery pack recess, and which also supports the PCB shown in FIG. 14.

As aforedescribed, the recess 30 formed in the battery frame 12 opens outwardly from a side edge 32 of the battery frame, as shown in FIG. 3. The PCB plate 14 is adapted for mounting on the battery frame 12 to become a part of the battery frame. The PCB plate 14 and PCB 100 define a boundary surface of the recess 30 opposite a planar wall surface 30*d* shown in FIG. 4. To this end, and referring to FIGS. 12 and 13 taken in conjunction with FIG. 4, the PCB plate 14 is made of a non-conductive material, such as a moldable polycarbonate, and has a planar surface 14*a* having a peripheral boundary substantially the same as the recess 30 formed in the battery frame 12. The PCB plate 14 has a forward inclined edge surface 90 that terminates at its upper edge in a recess 92 that compliments the recess 60 in the battery frame 12 to complete the LED mounting chamber for the LED 62 when the PCB plate 14 is mounted on the battery frame. To facilitate mounting on the battery frame, the PCB plate 14 preferably has a plurality of generally cylindrical mounting pins or pegs formed thereon, such as indicated at 96*a-d* in FIG. 13, that are inserted into correspondingly located pegholes formed in the battery frame 12. The mounting pegs and associated pegholes may couple in a friction fit or be secured by a suitable adhesive.

Figure 13:
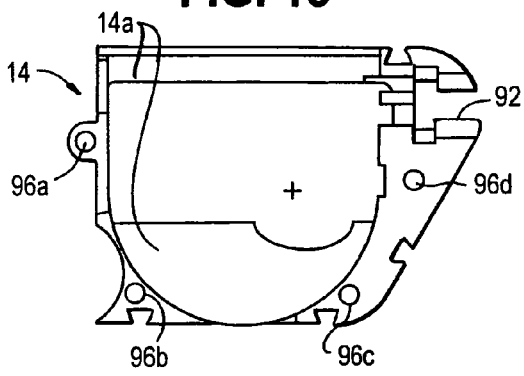
FIG. 13 shows the opposite side of the PCB plate of FIG. 12.

As seen in FIG. 13, the PCB plate 14 has a recess 98 formed therein, a portion 98*a* of which extends fully through the PCB plate. The recess 98 and corresponding through-portion 98*a* are configured to receive the PCB 100 therein and which is adapted to interconnect one of the leads of the LED to a positive terminal of the battery pack without effecting physical contact of the lead with the battery, as will be described.

A portion 98*b* of the recessed area 98 is provided to secure the PCB 100 to the PCB plate 14. A set of pegs 102*a-b* are provided to engage a corresponding set of pegholes 104*a-b* in the PCB 100.

Figure 14A:
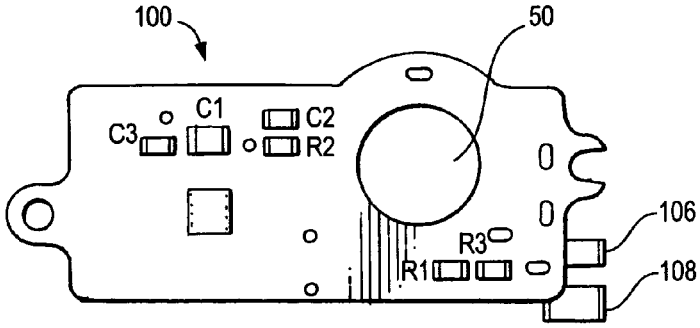
FIGS. 14*a-c* is a front, edge and a reverse perspective view of the PCB.
Figure 14B:
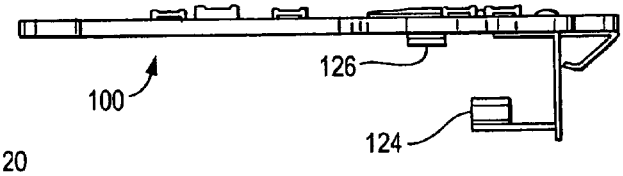
Figure 14C:
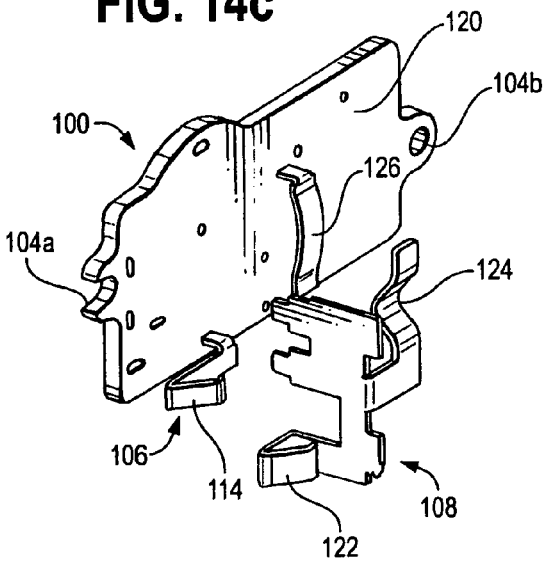

FIGS. 14*a-c* depict details of the PCB 100. FIG. 14*a* shows the circuit side, FIG. 14*b* shows an edge view and FIG. 14*c* shows an exploded, perspective view of the back of the PCB 100. FIG. 14*c* shows the side of the PCB 100 that faces the recess 30.

Figure 15:
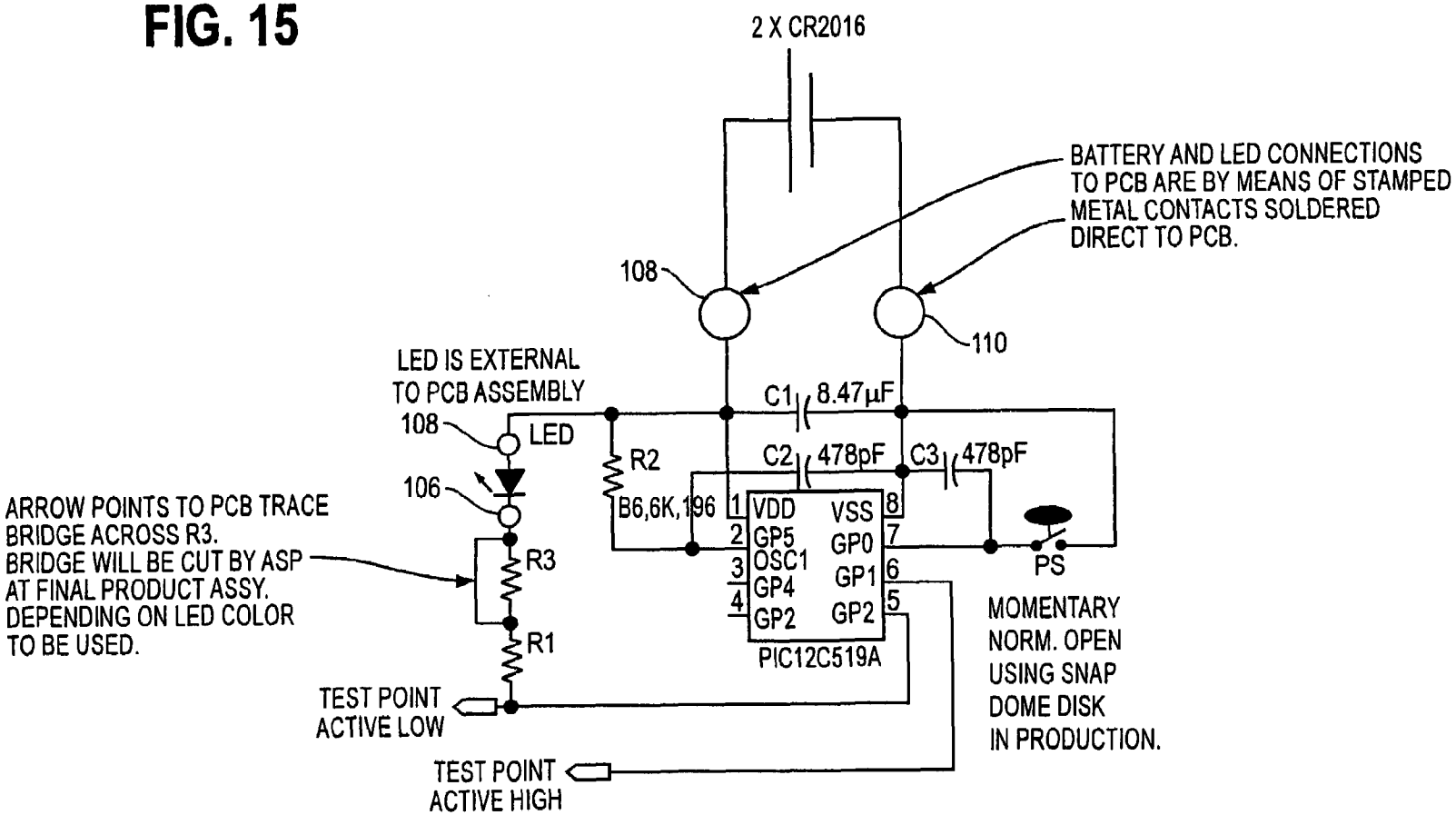
FIG. 15 is a schematic diagram of the PCB and interconnections with the LED and battery of FIG. 3.

FIG. 15 shows a schematic of the circuit located on the circuit side of FIG. 14. Reference to FIGS. 14*a-c* and 15 shall be made as appropriate to an understanding of the invention.

FIG. 14*c* shows first, second and third electrical conductors contacts 106, 108, 110. The first electrical conductor contact 106 is secured to the circuit board 120 within a first soldered through-hole 112 and has a tapered edge 114 for engaging a first lead of the LED 62. The soldered through hole 112 of the first contact 106 is connected to output GP2 of processor U1 shown in FIG. 15 through resistors R1 and R3.

The second electrical conductor contact 108 is connected to the circuit board 112 through a pair of soldered through-holes 116, 118. A first tapered edge 122 of the second contact 108 engages the second lead of the LED 62. A second recurved portion 124 is engages the positive terminal of the battery pack 44. The soldered through-holes 116, 118 are provided to connect with the resistor R2, capacitor C1 and the positive connection Vdd on the processor U1.

The third electrical conductor contact 110 is adapted to contact a negative terminal of the battery pack 44. A soldered through-hole (not shown) may be provided to couple the contact 110 to capacitors C1, C2, the negative connection Vss of the processor U1 and to the momentary contact pushbutton (PB) 50.

The PCB 100 may be assembled to the PCB plate 14 by inserting the pegs 102*a-b* into the pegholes 104*a-b*. The assembled PCB plate 14 may then be assembled to the side of the chamber 30. Within the chamber 30, the contact 124 extends across the width of the recess 30 and engages the battery pack 44 from the far side. The contact 126 engages the battery pack 44 from a near side. Assembly causes the first and second conductors 106, 108 are brought into contact with the leads of the LED 62.

The pushbutton 50 may be a snap dome switch plate with external cover. The pushbutton 50 may be constructed substantially as described in U.S. Pat. No. 6,190,018.

Figure 16:
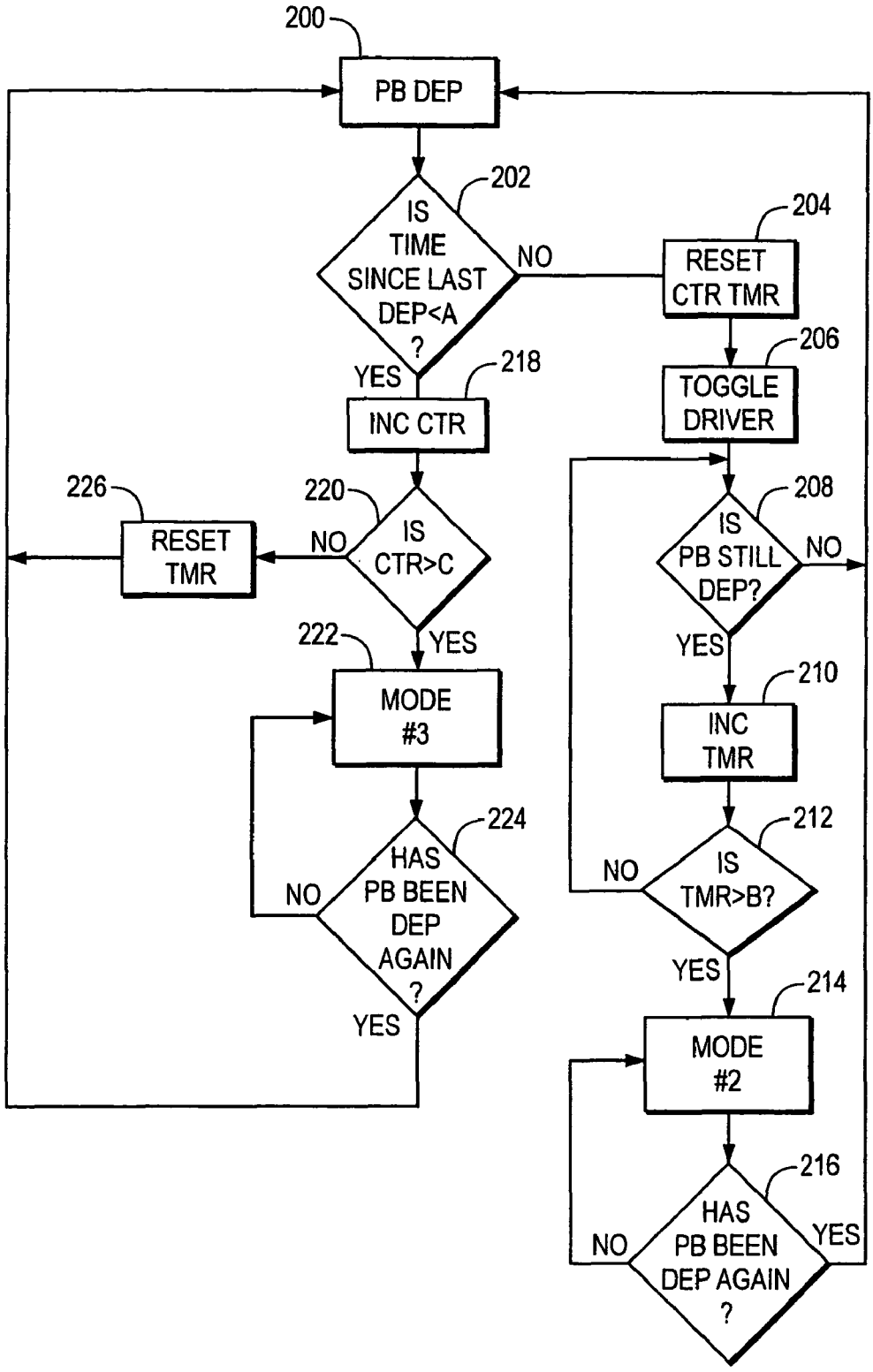
FIG. 16 is a flow chart that illustrates the mode selection of the flashlight 10 of FIG. 1.

FIGS. 16-18 and 29-31 are flow charts of a number of operating modes that may be assumed by the flashlight 10. FIG. 16 shows process steps of a mode selection program that allows the processor U1 to assume any of a number of different operating modes. While any number of different modes may be contemplated, three different modes will be described under illustrated embodiments of the invention.

The first mode may be a simple on-off mode. The second mode may be a flashing mode that may be accomplished by a flashing mode program using the steps depicted in the flow chart of FIG. 17. The third mode may be an SOS mode whereby the LED 40 flashes out the letters SOS in morse code. Operation under the third mode may be accomplished by an SOS mode program following the steps of the flow chart of FIG. 18.

The first mode may be a default mode assumed by the processor U1 upon startup. The second, flashing mode may be assumed by entry of some predetermined input code into a mode selector program 358 (FIG. 19) through the pushbutton 50 (e.g., depressing the button 50 continuously for 5 seconds). A timer subroutine 208, 210, 212 shown in FIG. 16 within the mode selector program 358 may be used to identify the input code for the flashing mode.

The third, SOS mode may be assumed by entering some other code into the mode selection program 358 through the pushbutton 50 (e.g., activating the pushbutton 50 in rapid succession three times with no more than 0.5 seconds between activations). A counter subroutine 200, 202, 218, 220, 222 shown in FIG. 16 within the mode selector program 358 may be used to identify the input code for the SOS mode.

As used herein, entry of an input code means the activation of the pushbutton 50 in such a manner as to match one or more predetermined timing (i.e., access) codes stored within the processor. It does not mean the simple activation of a pushbutton to turn a flashlight on or off or holding the pushbutton in a depressed state while the flashlight precesses through a number of operational states.

It should also be noted that each processing step described herein (or shown in the drawings) is associated with a subroutine (i.e., a physical processing element and processor) that accomplishes that step. Accordingly, each processing step described herein has a corresponding processor adapted to accomplish that step.

In order to conserve power, the processor U1 is programmed to assume a sleep mode between processing events. Insertion of a battery or a change in the state of port 0 (GP0) causes the processor to awaken, restore its registers and accept any new commands.

Turning now to FIG. 16 an explanation will be offered of a process through which the flashlight 10 may assume any one of three different modes. In each case, the processor U1 compares a temporal activation sequence of the pushbutton 50 with a predetermined access (e.g., timing) code associated with each mode. Where a match is found, the processor U1 enters the mode corresponding to the match.

As mentioned above, the processor U1 may wake-up upon detection of battery insertion or activation 200 of the pushbutton 50. Since the processor has just awakened, the time since the last depression of the pushbutton 50 will be some maximum value. Consequently, the first test 202 will be negative. Following the first test, a mode counter 318 (FIG. 19) and a repetition timer 310 that measures the time since the pushbutton was last activated may be reset 204 to zero. Following the reset, a driver 320 of the LED 40 will be toggled. IF the LED 40 were on, then the LED 40 would be toggled off. Alternatively, if the LED 40 where off, then the LED 40 would be toggled on.

As a next step, the processor U1 may test 208 whether the pushbutton 50 is still activated (i.e., depressed). If the pushbutton 50 is still being depressed, then a pushbutton timer 322 is incremented 210. The value within the pushbutton timer 322 is then compared within a pushbutton time comparator 324 to determine whether the time value has exceeded a pushbutton threshold value "B" (e.g., 5 seconds). If the value exceeds the threshold value "B", then the processor U1 enters 214 a second mode (i.e., mode #2).

Figure 19:
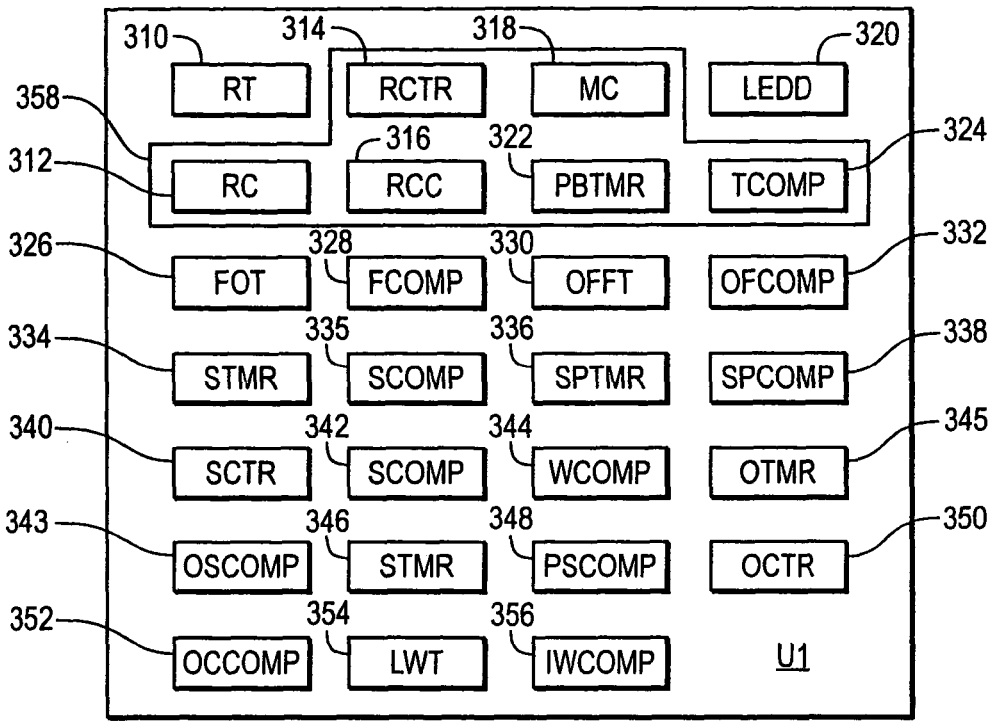
FIG. 19 is block diagram that illustrates the function blocks of the processor of FIG. 16.

Alternatively, if the pushbutton 50 where released and pressed again, then the processor U1 may proceed along another path. After the first activation of the pushbutton 50, the processor U1 has reset the repetition timer 310 (FIG. 19). The value of the repetition timer 310 may now be compared 202 within a repetition comparator 312 with a repetition threshold value "A" (e.g., 0.5 seconds) to detect a request for the third mode. In the case where the code for entry into the third mode is three rapid activations of the pushbutton 50, each time the comparator detects activation of the pushbutton within the time period "A", a repetition counter 314 may be incremented 218. The value within the repetition counter 314 may be compared with a threshold value "C" (e.g., 3) within a repetition counter comparator 316. If the value in the repetition counter 316 exceeds the threshold value, then the processor U1 enters mode #3.

Figure 17:
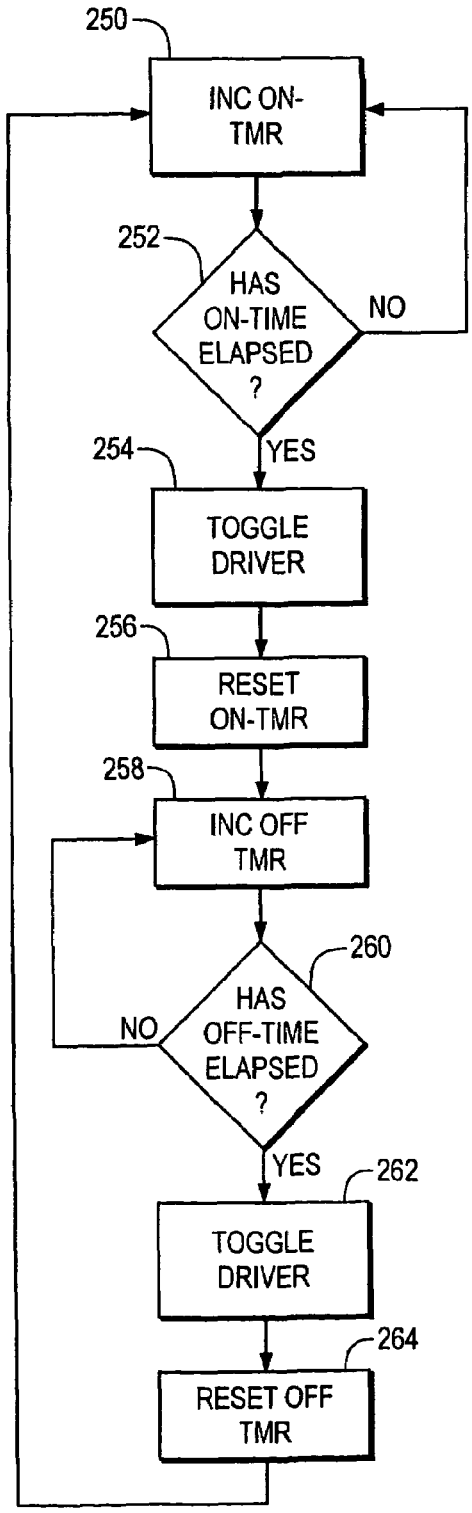
FIG. 17 is a flow chart that illustrates the flashing mode of FIG. 16.
Figure 18:
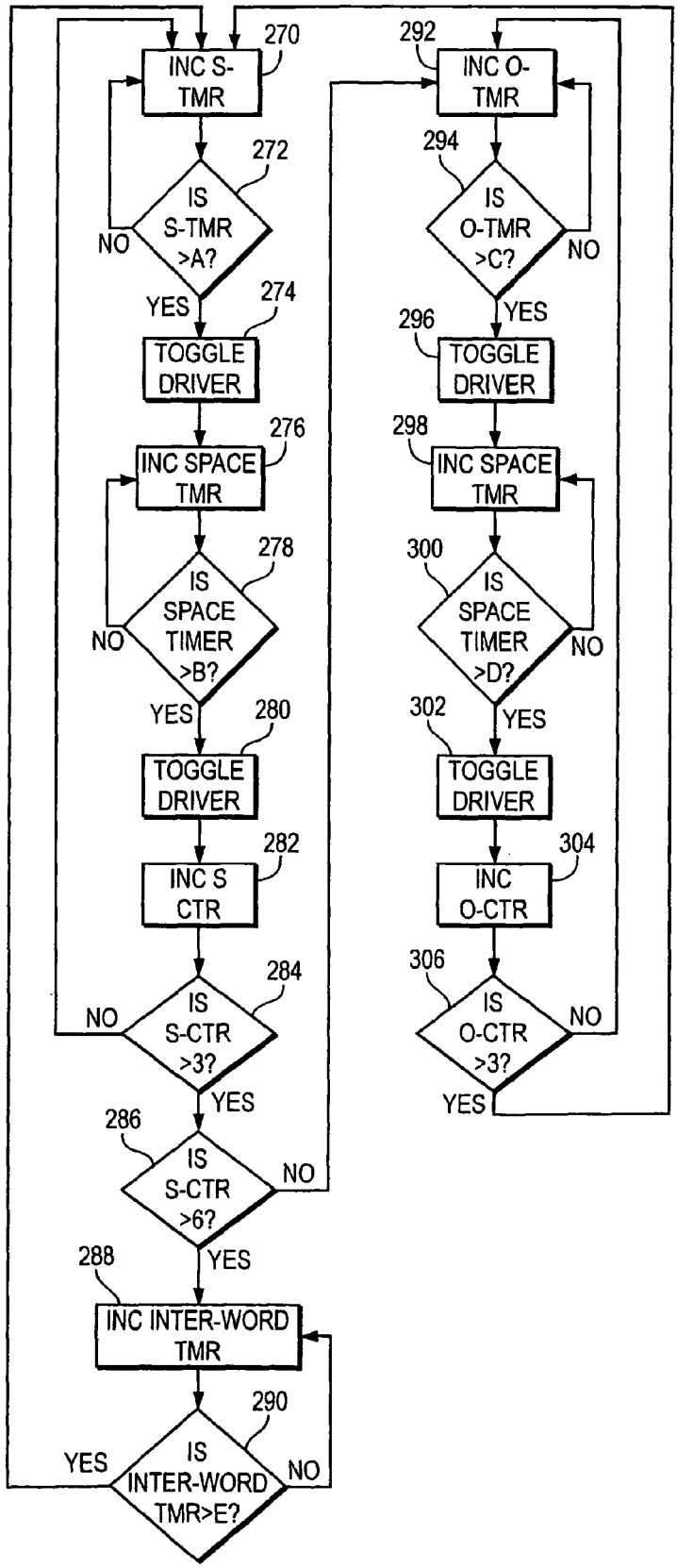
FIG. 18 is a flow chart that illustrates the SOS mode of FIG. 16.

If the processor U1 is in the mode #2 state, then the process of FIG. 17 may be followed to cause the LED 40 to flash (i.e., flicker) in some predictable manner. For example, the processor U1 may periodically increment 250 a flasher on-timer 326. After each increment, the processor U1 may compare a value within the on-timer 326 with a on-time threshold value in a flasher comparator 328. If the value within the on-timer 326 exceeds the threshold value, then the processor U1 may toggle 254 the driver 320 and begin incrementing 258 an off-timer 330. The value within the off-timer 330 may be compared in a comparator 332 with an off-time threshold value. When the off-timer 330 exceeds the off-threshold, the driver 320 is again incremented and the process repeats.

The on-timer 326 and off-timer 330 together define a flash rate of the flashlight 10 in cycles per minute. The flash rate may be selected to be commensurate with a person walking or jogging so that the light 10 assumes an on-state (i.e., flashes) each time the user's foot contacts the ground.

Further, the duty cycle may be adjusted to conserve battery energy during the flash mode (i.e., mode #2). For example, the on-time may be adjusted to be only a small percentage (e.g., 5% or less) of the total time of each flash cycle. The net result is a strobing effect that allows a user to clearly see his surroundings while at the same time maximizing battery life.

The process in mode #3 may be somewhat similar. However, since mode #3 involves morse code, the timing of the on and off cycles may be controlled based upon whether the code element is a dot or a dash. In general, the on-time of a dot may be controlled by a time value "A". The off-time between dots may be controlled by a time value "B". Similarly, the on-time of a dash may be controlled by time value "C" and the off-time by time value "D". A time period between transmission of code sequences may be controlled by a time value "E".

In general, the processor U1 operating in mode #3 may enter an S-generator (left column of FIG. 18) at step 270 where an S-timer 334 is incremented. After the S-timer is incremented, an S-comparator 335 compares 272 the value within the S-timer with the threshold time value "A". If the value within the S-timer 334 does not exceed the threshold value, then the value within the S-timer 334 is incremented and the process is repeated. If the S-timer exceeds the threshold value, then the LED driver 320 is toggled 274 and the processor U1 proceeds to begin measuring a time space between dots.

To measure a space, a space timer 336 is incremented 276. After incrementing the space timer 336, a comparator 338 compares the time within the space timer 336 with the threshold value "B". If the time does not exceed the threshold then the steps 276, 278 repeat. If the time exceeds the threshold, then the driver 320 is toggled 280 and the process to count the number of dots generated so far is initiated.

To count the number of dots, an S-counter 340 is incremented 282. After the S-counter 340 is incremented, an S-comparator 342 compares 284 the count within the S-counter 340 with a first threshold value (e.g., 3). If the S-counter 340 does not exceed the first threshold, the process 270, 272, 274, 276, 278, 280, 282, 284 repeats.

If the value within the S-counter 342 exceeds the first dot threshold value, then a word comparator 344 compares 286 the value within the S-counter 340 with a word threshold value (e.g., 6). When the value within the S-counter 340 exceeds the word threshold, then the process proceeds to an "O" generator (right column in FIG. 18).

As a first step, an O-timer 345 is incremented 292. After the O-timer 345 is incremented, a O-comparator 343 compares 294 the value within the O-timer 345 with a dash time threshold "C". If the threshold has not been exceeded, the timer 345 is incremented and the steps 292, 294 repeat If the threshold "C" is exceeded, then the processor U1 toggles 296 the driver 320 and a dash space timer 346 is incremented 298.

A dash-space comparator 348 then compares 300 the value within the dash space timer 346 with a threshold value "D". If the time does not exceed the value, then the timer is incremented and the steps 298, 300 repeat If the timer does exceed the threshold, then the driver 320 is toggled 302 and an O-counter 350 is incremented 304.

The O-counter 350 counts the number of dashes generated. An O-count comparator 352 then compares 306 the O-count with a threshold value (e.g., 3). If the O-count does not exceed the threshold, then the process steps 292, 294, 296, 298, 300, 302, 304, 306 repeat. If the O-count does exceed the threshold, then the process loops back to the dot generator and the sequence of dots repeats until the second set of dots has been generated.

Once the second set of dots has been generated, the word comparator 344 detects completion of the SOS sequence by comparison 286 of the value of the S-counter 340 with the threshold value (e.g., 6) and the process proceeds to an interword timer 356 that introduces a timer interval between SOS code sequences. The interword timer 356 is incremented 288. An interword comparator 356 compares 290 the value within the timer 354 with a threshold value (e.g., 2 seconds). If the value does not exceed the threshold, the timer 354 is incremented and the steps 288, 290 repeat. If the value does exceed the threshold, then the processor U1 proceeds to the first step 270 and the whole sequence repeats.

Figure 22:
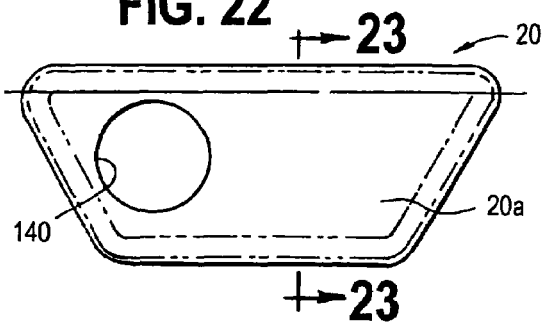
FIG. 22 is a side view of a side cover having an opening to receive the switch push button shown in FIGS. 29-30.
Figure 23:
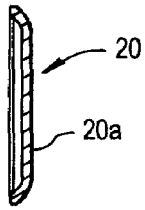
FIG. 23 is a transverse cross sectional view taken along line 23-23 of FIG. 22.
Figure 24:
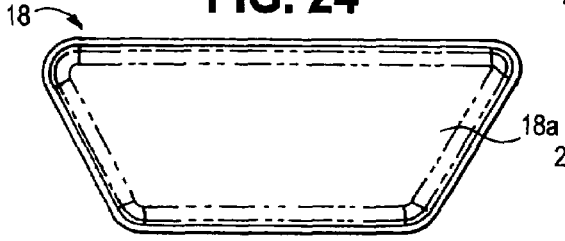
FIG. 24 is a side view of a second side cover.
Figure 25:
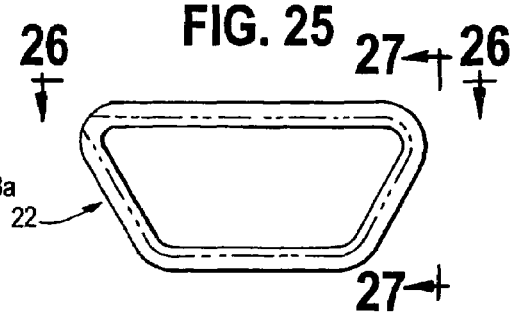
FIG. 25 is an elevational view of a side shell open frame used to retain a side cover against the battery frame.
Figure 26:
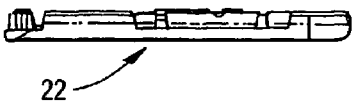
FIG. 26 is a top edge view taken along line 26-26 of FIG. 25.
Figure 27:
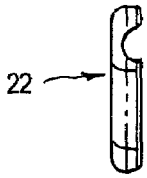
FIG. 27 is a side edge view taken along line 27-27 of FIG. 25.

Returning now to the physical structure of the flashlight 10, FIGS. 22 and 24 are side views of the side covers 20 and 18, respectively, which are substantially mirror images of each other and are adapted to be placed against opposite sides of the battery frame 12 when having the battery frame 14 mounted thereon as aforedescribed. To this end, the outer peripheries of the side covers 18 and 20 are sufficient to overlie the opposite sides of the battery frame and be secured thereagainst by the open-centered side shells or frames 22 and 24 which are substantially mirror images of each other and are adapted to be secured to the battery frame in a manner similar to the technique for attaching the housing sides 140 and 150 disclosed in U.S. Pat. No. 6,190,018 to the corresponding power source frame 22; namely, by forming pegs on the inner surfaces if the of the side shells 22 and 24 which are inserted into and retained within suitably positioned peg holes in the battery frame 12.

The side covers 18 and 20 are generally flat so as to form generally planar surface areas 18*a* and 20*a*, respectively, that preferably lie in parallel planes when assembled onto the battery frame 12 and retained thereagainst by the side shells 22 and 24. The side shells 22 and 24 substantially seal the peripheral edges of the side covers 18 and 20. The side covers 18 and 20 are made of a suitable strength material including metal, rubber, and plastic. The side covers are preferably made of aluminum, such as anodized 6061 aluminum, and their generally planar surfaces are suitable for putting indicia thereon by engraving or printing as aforedescribed.

The side cover 20 has a circular opening 140 formed therethrough and sized to receive the push button 50. The opening 140 is positioned so that when the side cover 20 is mounted on the side of the battery frame 12 on which the PCB plate 14 is mounted, the opening 140 is aligned with the push button 50. The push button 50 may be made of a relatively soft plastic material (e.g., Kraton) and has an outer dome shaped surface having a diameter equal to the opening 140.

Figure 6:
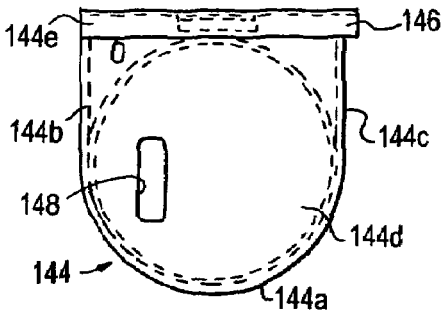
FIG. 6 is a front view of one-half of the battery holder that receives the battery of FIG. 20 to form the modular battery pack shown in FIG. 3.
Figure 7:
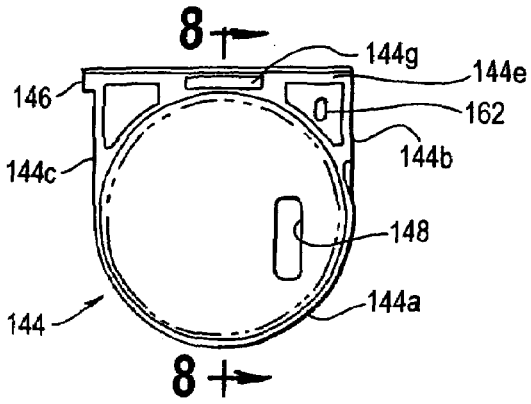
FIG. 7 shows the opposite side of the battery holder of FIG. 6.
Figure 8:
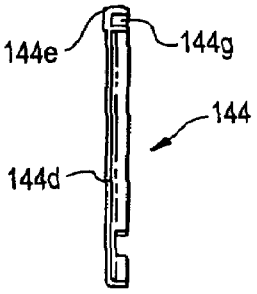
FIG. 8 is a sectional view taken along line 8-8 of FIG. 7.

FIGS. 6-8 illustrate one-half of a battery holder, indicated at 144, that is preferably made of polycarbonate and has a circular bottom end wall 144*a* that blends into parallel side walls 144*b* and 144*c* all of which are integral with a planar outer wall 144*d* of the battery holder. The sidewalls 144*b,c* and outer wall 144*d* are connected to an upper transverse rim 144*e* having an upper surface that forms one-half of the battery pack upper surface 46. The upper transverse rim 144*e* extends slightly beyond the adjacent sidewall 144*c* to define a portion of a projection 146 on the battery holder that is adapted to be received in a recess or notch 30*d* formed in the upper surface 46 of the battery frame 12, as considered in FIG. 4, thereby requiring a predetermined orientation of the batter pack in order to insert it fully into the recess 30 in the battery frame.

Figure 9:
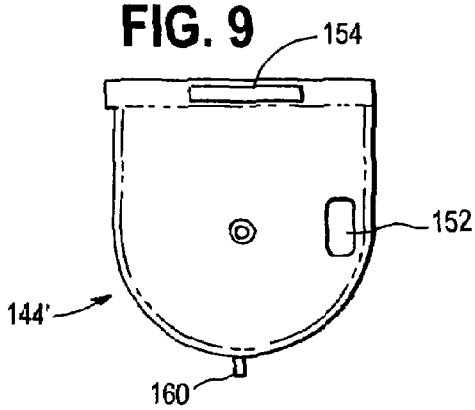
FIG. 9 is a front view of the other half of the battery holder that forms the modular battery pack.
Figure 10:
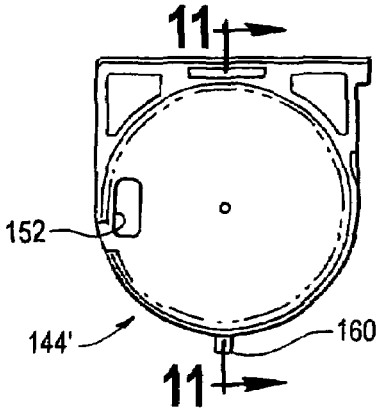
FIG. 10 shows the opposite side of the battery holder half of FIG. 9.
Figure 11:
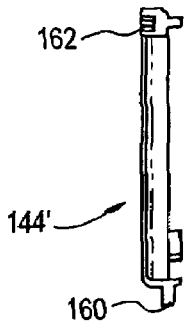
FIG. 11 is a sectional view taken along line 11-11 of FIG. 10.
Figure 20:
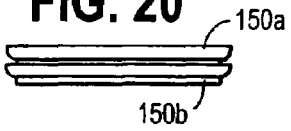
FIG. 20 is an edge view of a two-battery power source of the coin type that is enclosed within the battery holder to create the battery pack shown in FIG. 3.

FIGS. 9-11 illustrate the other half of the battery holder 44, indicated at 114'. FIG. 9 shows the outer surface of the battery holder half 144', and FIG. 10 shows the opposite inner surface. The battery holder half 144' is a substantial mirror image of the holder half 144 so that the battery holder halves can be secured together to form a holder having a circular interior chamber to receive a pair of stacked coin type batteries 150*a* and 150*b* as shown in FIG. 20. The planar wall 144*d* of the battery holder half 144 has a rectangular opening 148 formed therethrough which is preferably chamfered at its outer periphery in the outer exposed wall 144*d*. The rectangular opening 148 is adapted to expose the positive terminal of a pair of stacked batteries disposed within the battery holder and is positioned to receive the V-shaped portion 124 of the conductor contact 108 in continual contact with the battery terminal when the battery pack is disposed within the battery frame recess 30.

The battery holder half 144' has a rectangular opening 152 that is adapted to expose the negative terminal of the battery pack and is positioned to receive a negative conductor contact as indicated at 110 in FIG. 14*c*. The contact 110 is also preferably made of 301-302 stainless steel and has a generally curved portion 126 that projects into the opening 152 in the battery pack to constantly contact the negative battery terminal when the battery pack is inserted in the recess 30.

A cylindrical post 160 is formed on the battery pack, such as on the bottom of battery holder half 144', that can be inserted into the battery pack recess opening 56 in the battery frame 12 and used to partially eject a battery pack when the post 160 has been fully inserted into the recess. In this manner, a replacement battery pack can be used to assist in ejecting a battery pack from the battery frame to facilitate replacement.

A nail nick 154 is provided on a side of the battery pack near the top edge. Once the battery pack is partially ejected by the replacement battery pack, the user may insert his fingernail into the nail nick 154 and easily pull the old battery pack out of the flashlight 10.

A paper clip recess 162 may also be provided on a side of the battery pack near the top edge. The paper clip recess 162 allows the use of a paper clip for removal of the partially ejected battery pack.

Figure 29:
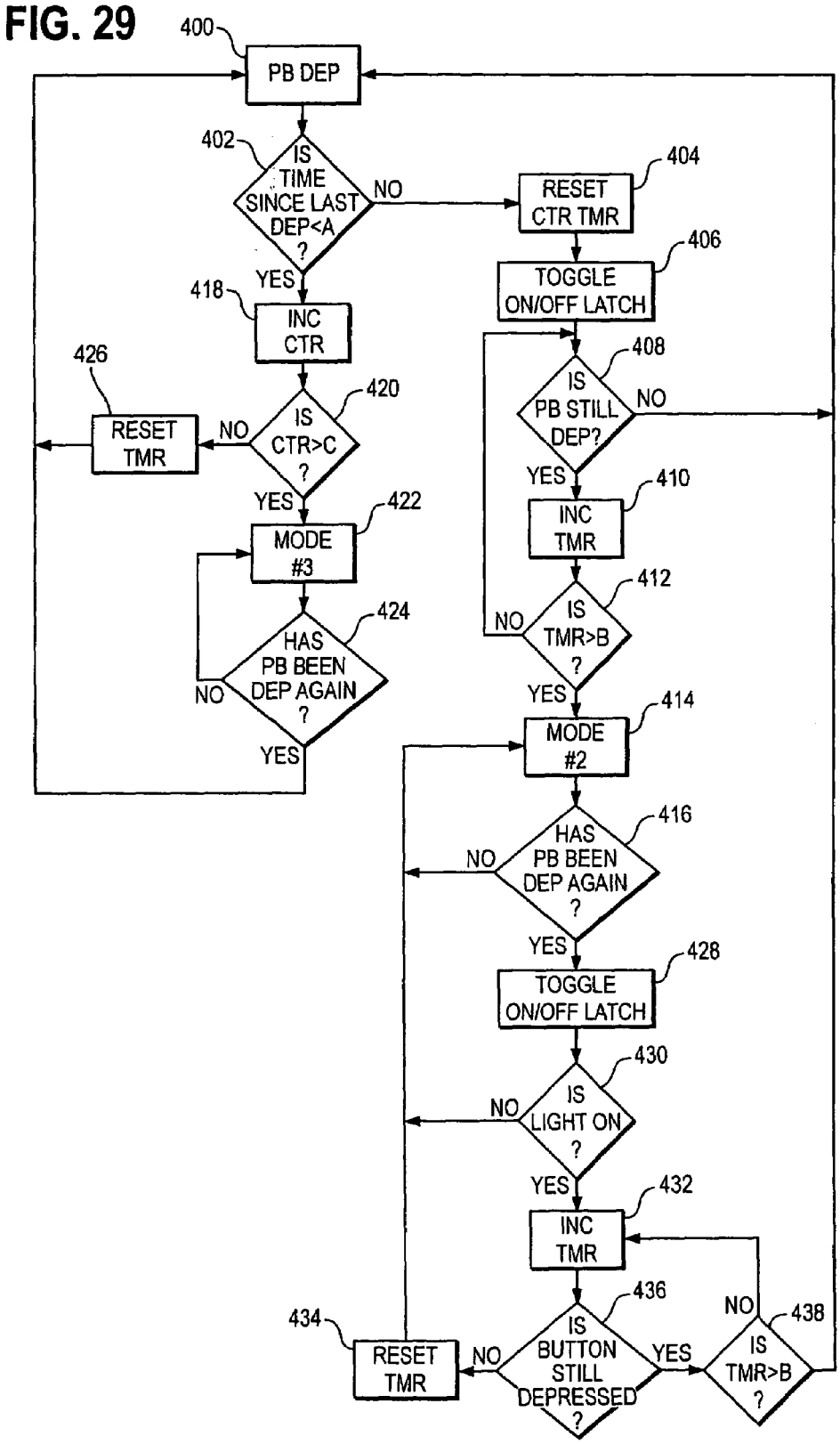
FIG. 29 is a flow chart that illustrates the mode selection of the flashlight 10 of FIG. 1 under an alternate illustrated embodiment.

In another illustrated embodiment of the invention (FIGS. 29-31), a separate on/off latch 504 (FIG. 30) is provided that operates independently of mode selection and that allows the flashlight 10 to be activated and deactivated without changing the previously selected operating mode. For example, FIG. 29 depicts a mode selection program that may be used with the flashlight 10. A first program loop (consisting of subroutine elements 400, 402, 404, 406, 408) is a default mode that may be entered without the use of a specific input code. Within the default mode, the light 512 of flashlight 10 to be activated and deactivated following the initial insertion of batteries by repeatedly activating the pushbutton 50. A "TOGGLE ON/OFF LATCH" subroutine 406 functions to toggle the "ON/OFF LATCH" 504 of FIG. 30.

Figure 30:
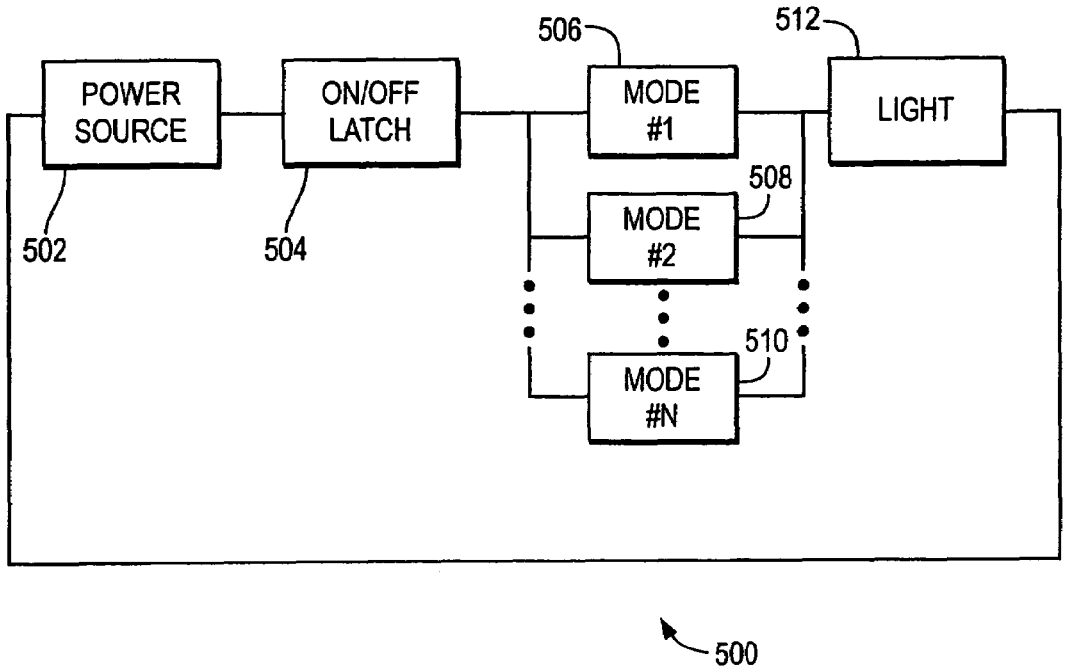
FIG. 30 is a circuit diagram that may be used in conjunction with the flow chart of FIG. 29.

As shown in FIG. 30, the toggling of the latch 504 alternately applies power to and removes power from the mode control blocks 506, 508, 510. Since only one mode at a time would be active, the application of power to the mode control blocks 506, 508, 510 would activate the light 512 in accordance with the programming of the respective, active mode control block 506, 508, 510.

For example, if block 508 is the flashing mode and the flashing mode is selected as the active mode by entry of the appropriate input code, then the application of power to block 508 would cause the light 512 to flash as described with respect to FIG. 17. Similarly, if block 510 is the SOS mode and the SOS mode is selected, then the application of power to block 510 would cause the light 512 to flash as described with respect to FIG. 18.

In the example above, where the subroutine elements 400, 402, 404, 406, 408 defines the default mode, activation of the button 50 while in the default (on/off) mode would simply result in the light 512 turning on and off. In this case, the "TOGGLE ON/OFF LATCH" 406 of FIG. 29 would toggle the latch 504 in FIG. 30. Toggling of the latch 504 in the default mode would cause power to pass through the block 506 and activate and deactivate the light 512 in direct relation to toggling of the latch 504.

A second program loop (including subroutine elements 400, 402, 404, 406, 408, 410, 412) functions to detect entry of the input code for the flashing mode. In this case, the flashlight 10 enters the timing loop 408, 410, 412 in which the time duration that the button 50 has been activated is compared with a predetermined time period "B". Where the time period exceeds the predetermined time period "B" (as detected by the time comparison subroutine 412), the flashlight 10 enters the flashing mode (mode 2) 414.

It should be noted in this embodiment that a difference exists between entry of an input code and activation and deactivation of the flashlight 10. Once the flashlight 10 has entered the flashing mode 414, the flashlight 10 may be activated and deactivated by a single activation of the pushbutton 50. The deactivation of the flashlight 10 causes all light output from the flashlight 10 to cease until the pushbutton 50 is again activated, thereby again activating the flashlight 10. Once the flashlight 10 is again activated, the light 512 may immediately begin flashing as described in conjunction with FIG. 17.

Once in the flashing mode, a button reading routine 414, 416 functions to continuously detect activation of the button 50. Once activation of the button 50 is detected, a toggling routine 414, 416, 428, 430 functions to activate and deactivate the flashlight 10 while the flashlight 10 remains in the flashing mode. As above, a "TOGGLE ON/OFF LATCH" routine 428 functions to turn the flashlight 10 on and off (while the flashlight 10 remains in the flashing mode) by toggling the "ON/OFF LATCH" 504 of FIG. 30.

In order to exit the flashing mode, a flashing mode exit subroutine 430, 432, 436, 438 may be used. In this case, the light 10 enters a timing loop 432,436, 438 when the button 50 is activated while in the flashing mode. If the button 50 is held in an activated position for the predetermined time period "B", then the flashlight 10 exits the flashing mode and reverts to the basic on/off mode.

In another embodiment, the operating modes of the flashlight 10 may be progressively entered and exited through the use of various input codes. The progressive entry of operating modes may be useful in a number of applications such as control of power to the light 512 or for progressive signaling applications.

In the case of the flashlight 10, the progressive control of power to the light source 512 may have value in the case where the light source 40 is a high pressure, high intensity incandescent lamp. In this case, it may be possible (and even desirable) to provide a variable power level to the lamp 40. The variable power level may be used to allow a high power level during short periods where a higher level of light is needed (e.g., during emergencies) and a lower level of light output at other times to extend battery life.

Figure 31:
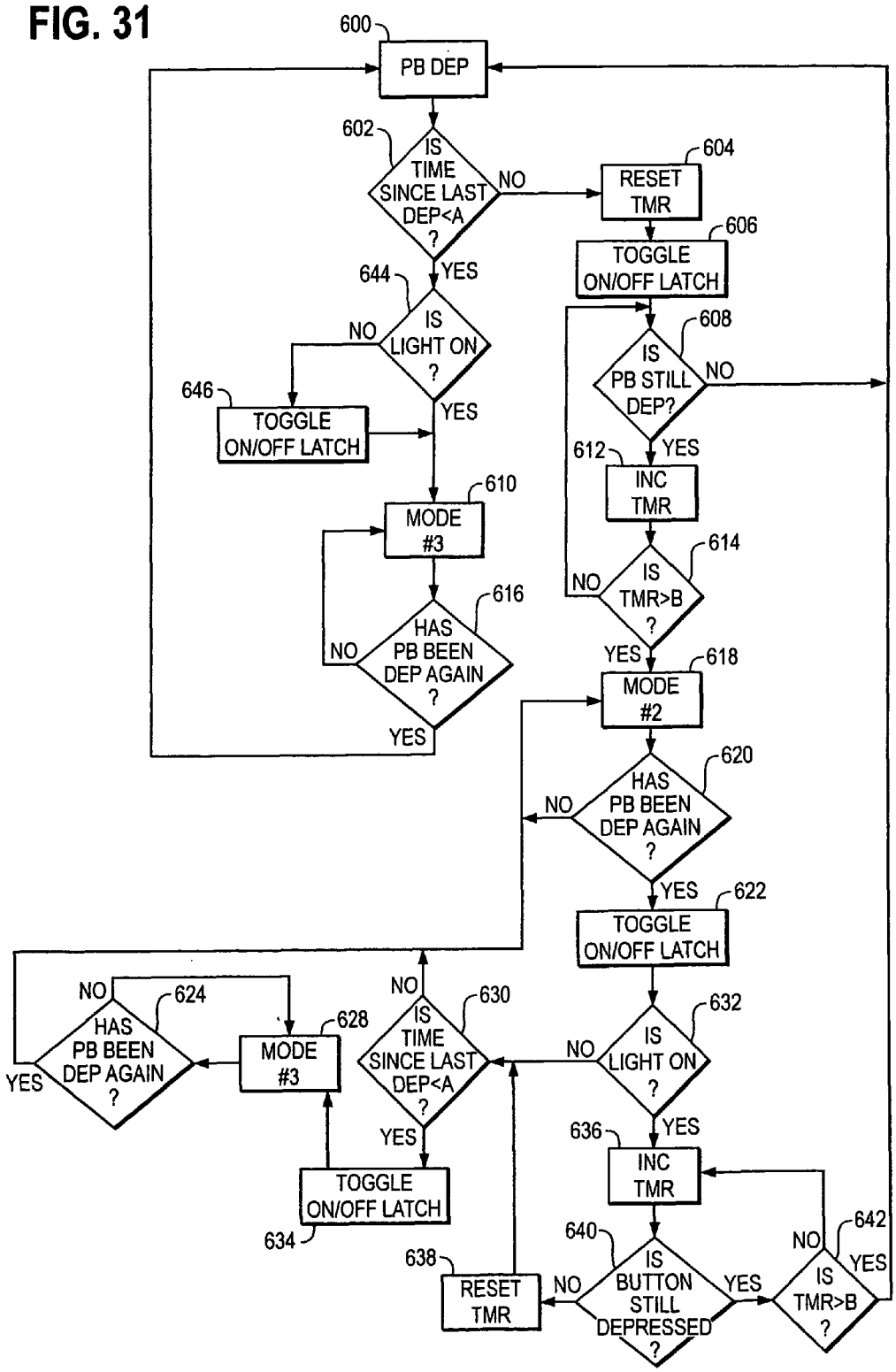
FIG. 31 is a flow chart that illustrates mode selection of the flashlight 10 of FIG. 1 under yet another alternate illustrated embodiment.

FIG. 31 depicts a program that may be used for the progressive entry and exit of operating modes based upon the entry of input codes. In the program of FIG. 31, a user may enter mode 2 using a first input code. From mode 2, the user can enter mode 3 by entry of a second input code. Alternatively, the user may enter mode 3 from the default mode by entry of the second input code. In either case, the user may exit mode 3 and return to the previous operating mode by entry of a fourth input code.

Turning now to the specifics of FIG. 31, it may be noted that upon insertion of a battery, the program may enter a first operating mode defined by subroutines 600, 602, 604, 606, 608. It may be noted that the first mode is a default mode that is entered without the use of a specific input code. Upon entry into the default mode, the flashlight may remain within a looping routine 600 that monitors for activation of the pushbutton 50.

Upon activation of the pushbutton 50, control may transfer to a time interval testing subroutine 602 that measures whether the time interval since the last activation of the pushbutton 50 is less than some time interval (e.g., one-half second). If the time interval is less than one-half second, then control passes to a reset subroutine 604 that resets a pushbutton timer and a toggling routine 606 that toggles the latch 504. After toggling the latch 504, control passes to a code detection loop 608, 612, 614 that detects entry of the first input code. The code detection loop 608, 612, 614, in this case may be a timing loop that detects a time interval that the pushbutton 50 has been activated. If the pushbutton 50 is released before some time period "B" has passed (e.g., 5 seconds), then control returns to the looping routine 600.

If the pushbutton 50 remains activated for more than time period "B", then the first input code is determined as having been identified by the code detection loop 608, 612, 614 and the flashlight 10 enters mode 2. In mode 2, the light 512 flashes substantially as described in conjunction with FIG. 17. In this case, the block 508 of FIG. 30 may be thought of as providing the functionality associated with the drivers 254, 262 of FIG. 17.

While in mode 2, control of activation and deactivation of the flashlight 10 is provided by a main loop 618, 620, 622, 632, 630. A looping routine 618, 620 is provided to detect activation of the pushbutton 50. When the pushbutton 50 is activated, a subroutine 622 toggles the latch 504.

Once the latch 504 has been toggled, a light status subroutine 632 determines whether the light 512 is on or off. If the light 512 is off, then a time interval routine 630 determines whether the time interval since the last activation is less than some time interval "A" (e.g., one-half second). If it is not, then control returns to the looping routine 618, 620.

If the light status subroutine 632 determines that the light is on, then control is transferred to a timing loop 636, 640, 642. Within the timing loop 636, 640, 642, the duration of activation of the pushbutton 50 is measured. If the duration is greater than the predetermined time interval "B" (e.g., 5 seconds), then the flashlight 10 exits mode 2. If the pushbutton 50 is released before the predetermined time interval, then a reset subroutine 638 resets the timer and timer routine 630 determines whether the time since the last activation is less than the time interval "A". If not, then control returns to the looping routine 618, 620.

If, however, while in mode 2, the second input code (e.g., for mode 3) where entered through the pushbutton 50, then control of the light 512 would be transferred to the third mode. In this case, the subroutines 618, 620, 622, 632, 630, 636, 638, 640 functions as a code detection loop for the second input code (e.g., activation of the pushbutton 50 twice within a predetermined time period "A"). In this case, the operative part of the code detection loop is the subroutine 630 that tests and detects whether the pushbutton 50 has activated twice within the time period "A" (e.g., one-half second). If the subroutine 630 detects activation of the pushbutton 50 twice within the time period "A", then a toggle subroutine 634 would toggle the latch 504 and enter the mode 3 subroutine 628.

As an alternative, the flashlight 10 may also enter mode 3 from the default mode. In this case, the subroutines 600, 602, 604, 606, 608 also functions as a code detection loop for the second input code. In this case, the operative part of the code detection loop is the subroutine 602 that tests and detects whether the pushbutton 50 has activated twice within the time period "A" (e.g., one-half second). If the subroutine 602 detects activation of the pushbutton 50 twice within the time period "A", then a light detection subroutine 644 detects whether the light 512 is activated and, if not, then a toggle subroutine 646 toggless the latch 504 and enters the mode 3 subroutine (here identified by the reference number 610).

Once the flashlight 10 enters mode 3, a code detection routine 610, 616 or 628, 624 monitors for entry of the third input code. Under the illustrated embodiment, the third input code may simply be detection of the momentary activation of the pushbutton 50. It should be noted in this regard that entry of the third input code does not by itself result in deactivation of the flashlight 10 or of the light 512. More to the point, entry of the third input code simply results in the flashlight 10 reverting to the mode that it had previously occupied before entry into the third mode. For example, if the flashlight 10 had entered the third mode from the default mode, then the operational state of the flashlight 10 would be controlled by the box labeled 610 in FIG. 31. If the code detection subroutine 616 should detect activation of the pushbutton 50, then the flashlight 10 would revert to the default state without any toggling of the latch 504. As a result, the flashlight 10 would enter the default state with the light 512 in the activated state.

If the flashlight 10 had entered the third mode from the second mode, then a similar process may be followed. In this case, the flashlight 10 would remain in a looping subroutine 628, 624 until the pushbutton 50 is again activated. When the pushbutton 50 is again activated, the input code detector 624 detects the third input code and the flashlight 10 returns to the mode 2 subroutine 618. As above, reversion to the mode 2 subroutine 618 does not deactivate the flashlight 10. Instead, the flashlight 10 continues to operate under the operating conditions provided by the mode 2 program 618.

If the user should then desire to exit the mode 2 subroutine 618, then the user may enter the first input code and return to the default mode. Entry of the first input code, in this case, may be detected by the code detection routine 636, 640, 642. Once entry of the first input code is verified by the code detection routine, the flashlight 10 may return to the default mode.

It should be noted that while some elements of the programs are depicted in multiple instances, the routines may exist as a single instance with calls from multiple locations. For example, mode 3 and the code detector for the third input code are depicted in one instance by the reference numbers 610, 616 and in another instance by the reference numbers 628, 624. In this case, execution of the mode 3 routine may be accomplished by a jump instruction from multiple locations. In the case of a jump instruction, a code stack may be used to store (i.e., PUSH) a pointer identifying a location of the calling routine. Upon detection of the entry of the third input code, a return statement may be executed that results in the execution of a return instruction. Execution of a return instruction may result in POPing the stack to retrieve a pointer to the next instruction.

It can thus be seen that the flashlight in accordance with the present illustrated embodiment can be readily operated by selection of any of a number of different operating modes via operation of the pushbutton 50. Selection of operating modes may be accomplished by entry of any of a number of different codes through the pushbutton 50. Once a mode is selected, an internal processor automatically activates the light source 62, 512 in accordance with the selected operating mode. These features, coupled to the replaceable battery pack feature, presents a small flat flashlight that is a marked improvement over known flashlights.

While a preferred embodiment of the present invention has been illustrated and described, it will be understood that changes and modifications may be made therein without departing from the invention in its broader aspects.

What is claimed is:

1. A method of operating a flashlight comprising the steps of:

providing the flashlight with a plurality of different light source operating modes;

providing a momentary contact on a body of the flashlight;

detecting entry of a plurality of input codes through the momentary contact where each input code identifies a respective one of the plurality of light source operating modes; and activating and deactivating a light source of the flashlight through a single respective activation of the momentary contact in each of the plurality of operating modes without changing the operating mode.

2. The method of operating the flashlight as in claim 1 wherein one of the plurality of operating modes further comprises an on/off mode.

3. The method of operating the flashlight as in claim 2 further comprising activating the momentary contact once to continuously activate the light source of the flashlight in the on/off mode.

4. The method of operating the flashlight as in claim 1 wherein one of the plurality of operating modes further comprises a flashing mode.

5. The method of operating the flashlight as in claim 4 further comprising activating the momentary contact continuously for a predetermined time period to select the flashing mode.

6. The method of operating the flashlight as in claim 5 wherein the continuous activation of the momentary contact for selecting the flashing mode further comprises 5 seconds.

7. The method of operating the flashlight as in claim 5 further comprising activating the momentary contact for less than the predetermined time period to activate and deactivate the flashlight in the flashing mode.

8. The method of operating the flashlight as in claim 5 further comprising exiting the flashing mode by activating the momentary contact a second time for the predetermined time period.

9. The method of operating the flashlight as in claim 8 wherein the step of exiting the flashing mode further comprises returning to an onloff mode.

10. The method of operating the flashlight as in claim 1 wherein one of the plurality of operating modes further comprises an SOS mode.

11. The method of operating the flashlight as in claim 10 further comprising activating the momentary contact a plurality of times in rapid succession to select the SOS mode.

12. The method of operating the flashlight as in claim 11 wherein the step of activating the momentary contact a plurality of times in rapid succession to select the SOS mode further comprises activating the momentary contact three times wherein each activation is no more than one-half second apart.

13. The method of operating the flashlight as in claim 12 wherein the step of activating the momentary contact three times to select the SOS mode further comprises exiting the SOS mode by activating the momentary contact a fourth time.

14. The method of operating the flashlight as in claim 13 wherein the step of exiting the SOS mode further comprises returning to an on/off mode.

15. The method of operating the flashlight as in claim 10 wherein the SOS mode further comprises generating a morse code light signal for the letters SOS.

16. A flashlight comprising:

means for activating a light source of the flashlight under one of a plurality of different light source operating modes;

a momentary contact provided on a body of the flashlight;

means for detecting entry of a plurality of input codes through the momentary contact where each input code identifies a respective one of the plurality of light source operating modes, and means for activating and deactivating a light source of the flashlight through a single respective activation of the momentary contact in each of the plurality of operating modes without changing the operating mode.

17. The flashlight as in claim 16 wherein one of the plurality of operating modes further comprises an on/off mode.

18. The flashlight as in claim 17 wherein the input code for the on/off mode further comprises activating the momentary contact once to continuously activate the light source of the flashlight in the on/off mode.

19. The flashlight as in claim 16 wherein one of the plurality of operating modes further comprises a flashing mode.

20. The flashlight as in claim 19 wherein the input code for the flashing mode further comprises means for detecting activation of the momentary contact continuously for a predetermined time period to select the flashing mode.

21. The method of operating the flashlight as in claim 20 wherein the predetermined time period further comprises 5 seconds.

22. The flashlight as in claim 20 further comprising means for detecting activation of the momentary contact for less than the predetermined time period to activate and deactivate the flashlight in the flashing mode.

23. The flashlight as in claim 20 further comprising means for exiting the flashing mode by activating the momentary contact a second time for the predetermined time period.

24. The flashlight as in claim 16 wherein one of the plurality of operating modes further comprises an SOS mode.

25. The flashlight as in claim 24 wherein the input code for the SOS mode further comprises means for detecting activation of the momentary contact a plurality of times in rapid succession to select the SOS mode.

26. The flashlight as in claim 25 wherein the input code for the SOS further comprises means for detecting activation of the momentary contact three times wherein each activation is no more than one-half second apart.

27. The flashlight as in claim 26 wherein the means for detecting entry of an input code further comprises means for exiting the SOS mode by activating the momentary contact a fourth time.

28. The flashlight as in claim 24 wherein the SOS mode further comprises means for generating a morse code light signal for the letters SOS.

29. A flashlight comprising:

a processor adapted to activate a light source of the flashlight under one of a plurality of different light source operating modes;

a momentary contact provided on a body of the flashlight;

a plurality of mode programs where each mode program of the plurality of mode programs corresponds to a respective light source operating mode of the plurality of operating modes;

a mode selection program adapted to detect entry of a plurality of input codes through the momentary contact where each input code identifies a respective one of the plurality of mode programs and light source operating modes; and a toggling routine adapted to activate and deactivate the flashlight through a single respective activation of the momentary contact in each of the plurality of light source operating modes without changing the operating mode.

30. The flashlight as in claim 29 wherein one of the plurality of operating modes further comprises a flashing mode.

31. The flashlight as in claim 30 wherein the input code for the flashing mode further comprises a timer subroutine adapted to detect activation of the momentary contact continuously for a predetermined time period to select the flashing mode.

32. The flashlight as in claim 31 wherein the predetermined time period further comprises 5 seconds.

33. The flashlight as in claim 31 further comprising means for detecting activation of the momentary contact for less than the predetermined time period to activate and deactivate the flashlight in the flashing mode.

34. The flashlight as in claim 31 further comprising a flashing mode exit subroutine adapted to exit the flashing mode when the momentary contact is activated a second time for the predetermined time period.

35. The flashlight as in claim 29 wherein one of the plurality of operating modes further comprises an SOS mode.

36. The flashlight as in claim 35 wherein the input code for the SOS mode further comprising a counter subroutine adapted to detect activation of the momentary contact a plurality of times in rapid succession to select the SOS mode.

37. The flashlight as in claim 36 wherein the counter subroutine for detecting the input code for the SOS further comprises a timer subroutine adapted to reject any input codes where any activation is more than one-half second apart.

38. The flashlight as in claim 37 wherein the means for detecting entry of an input code further comprises a flashing mode exit subroutine adapted to exit the SOS mode when the momentary contact is activated a fourth time.

39. The flashlight as in claim 35 wherein the SOS mode further comprises a SOS program adapted to generate a morse code light signal for the letters SOS.

40. A method of operating a flashlight comprising the step of:

providing the flashlight with a plurality of different light source operating modes;

providing a momentary contact on a body of the flashlight;

detecting entry of a plurality of input codes through the momentary contact where each input code of the plurality of input codes selects a respective operating mode of the plurality of light source operating modes;

providing a toggling routine for each of the plurality of operating modes; and activating, deactivating and activating the flashlight within each of the plurality of operating modes via a single respective activation of the momentary contact and toggling routine without changing the operating mode.

41. The method of operating the flashlight as in claim 40 wherein one of the plurality of operating modes further comprises an on/off mode.

42. The method of operating the flashlight as in claim 41 further comprising activating the momentary contact once to continuously activate a light source of the flashlight in the on/off mode.

43. The method of operating the flashlight as in claim 41 wherein one of the plurality of operating modes further comprises a flashing mode.

44. The method of operating the flashlight as in claim 43 further comprising activating the momentary contact continuously for a predetermined time period to select the flashing mode.

45. The method of operating the flashlight as in claim 44 wherein the continuous activation of the momentary contact for selecting the flashing mode further comprises 5 seconds.

46. The method of operating the flashlight as in claim 44 further comprising exiting the flashing mode by activating the momentary contact a second time for the predetermined time period.

47. The method of operating the flashlight as in claim 46 wherein the step of exiting the flashing mode further comprises returning to an on/off mode.

48. The method of operating the flashlight as in claim 43 further comprising activating the momentary contact for less than the predetermined time period to activate and deactivate the flashlight in the flashing mode.

49. The method of operating the flashlight as in claim 40 wherein one of the plurality of operating modes further comprises an SOS mode.

50. The method of operating the flashlight as in claim 49 further comprising activating the momentary contact a plurality of times in rapid succession to select the SOS mode.

51. The method of operating the flashlight as in claim 50 wherein the step of activating the momentary contact a plurality of times in rapid succession to select the SOS mode further comprises activating the momentary contact three times wherein each activation is no more than one-half second apart.

52. The method of operating the flashlight as in claim 51 wherein the step of activating the momentary contact three times to select the SOS mode further comprises exiting the SOS mode by activating the momentary contact a fourth time.

53. The method of operating the flashlight as in claim 52 wherein the step of exiting the SOS mode further comprises returning to an on/off mode.

54. The method of operating the flashlight as in claim 53 wherein the SOS mode further comprises generating a morse code light signal for the letters SOS.

55. The method of operating the flashlight as in claim 49 wherein the SOS mode further comprises generating a morse code light signal for the letters SOS.

56. The method of operating the flashlight as in claim 54 wherein the step of activating the momentary contact a plurality of times in rapid succession to select the SOS mode further comprises activating the momentary contact three times wherein each activation is no more than one-half second apart.

57. The method of operating the flashlight as in claim 56 wherein the step of activating the momentary contact three times to select the SOS mode further comprises exiting the SOS mode by activating the momentary contact a fourth time.

58. The method of operating the flashlight as in claim 57 wherein the step of exiting the SOS mode further comprises returning to an on/off mode.

* * * * *